US012031791B2

(12) United States Patent
Hsu

(10) Patent No.: US 12,031,791 B2
(45) Date of Patent: Jul. 9, 2024

(54) PISTOL LOWER RECEIVER REAR RAIL INSERTS

(71) Applicant: BlackHawk Manufacturing Group Inc., Garden Grove, CA (US)

(72) Inventor: Sheehan Hsu, Anaheim, CA (US)

(73) Assignee: BlackHawk Manufacturing Group Inc., Fort Worth, TX (US)

( * ) Notice: Subject to any disclaimer, the term of this patent is extended or adjusted under 35 U.S.C. 154(b) by 0 days.

(21) Appl. No.: 18/054,335

(22) Filed: Nov. 10, 2022

(65) Prior Publication Data

US 2023/0266081 A1 Aug. 24, 2023

Related U.S. Application Data

(60) Provisional application No. 63/263,915, filed on Nov. 11, 2021.

(51) Int. Cl.
*F41A 3/66* (2006.01)
*F41A 19/10* (2006.01)

(52) U.S. Cl.
CPC ..... *F41A 3/66* (2013.01); *F41A 19/10* (2013.01)

(58) Field of Classification Search
CPC ..... F41A 5/04
USPC ..... 89/195–196
See application file for complete search history.

(56) References Cited

U.S. PATENT DOCUMENTS

| | | | | |
|---|---|---|---|---|
| 4,539,889 | A | 9/1985 | Glock | |
| 5,669,169 | A * | 9/1997 | Schmitter | F41A 3/66 89/196 |
| 5,717,156 | A * | 2/1998 | Lenkarski | F41A 3/64 89/196 |
| 8,156,677 | B2 | 4/2012 | Glock | |
| 8,528,243 | B1 | 9/2013 | Glock | |
| D702,308 | S | 4/2014 | Glock | |
| 8,695,262 | B2 | 4/2014 | O'Clair et al. | |
| 9,074,831 | B2 | 7/2015 | Glock | |
| 10,254,059 | B1 | 4/2019 | Fellows et al. | |
| 10,739,090 | B2 | 8/2020 | Borges et al. | |
| 11,236,967 | B2 * | 2/2022 | Tai | F41C 3/00 |
| 11,441,858 | B2 * | 9/2022 | Borges | F41A 3/66 |
| 2013/0036644 | A1 | 2/2013 | Bardy | |
| 2017/0095907 | A1 | 4/2017 | McClain | |
| 2017/0321980 | A1 | 11/2017 | Wolf | |
| 2020/0217604 | A1 | 7/2020 | Borges et al. | |

* cited by examiner

*Primary Examiner* — Reginald S Tillman, Jr.
(74) *Attorney, Agent, or Firm* — Wood Herron & Evans LLP

(57) ABSTRACT

A pistol frame can include a trigger mechanism recess, an upper rim extending about the trigger mechanism recess, a rear insert recess within the trigger mechanism recess, a left rear rail insert, and a right rear rail insert. The left rear rail insert can include an upper portion including a left rail and a lower portion including a first pin aperture. The right rear rail insert can include an upper portion including a right rail and a lower portion including a second pin aperture. The pistol frame can include a first and second pin hole aligned with the trigger mechanism recess and a pin that can extend through the first and second pin holes and through the first and second pin apertures.

12 Claims, 15 Drawing Sheets

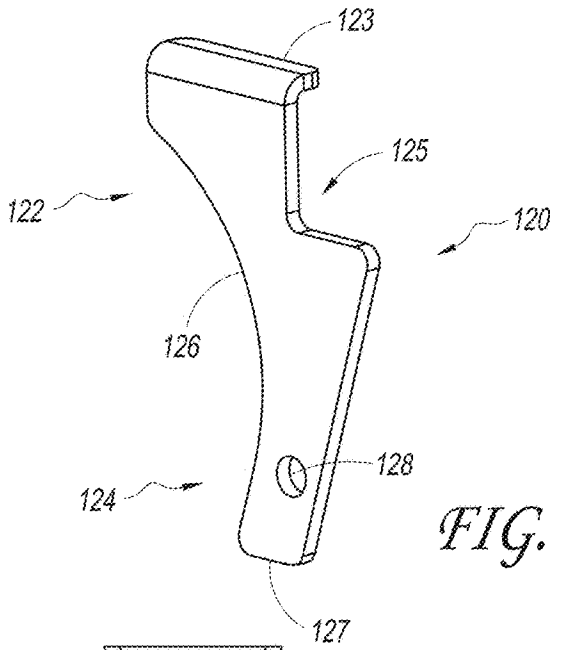
FIG. 2A
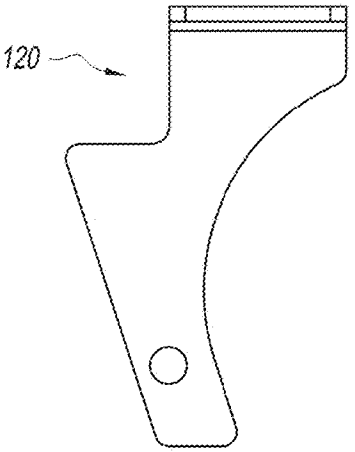
FIG. 2B
FIG. 2C
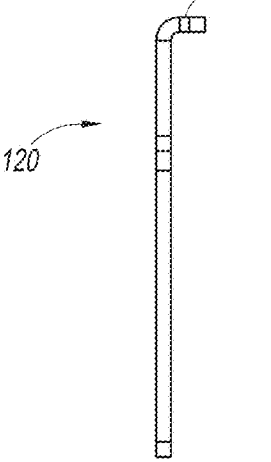
FIG. 2D
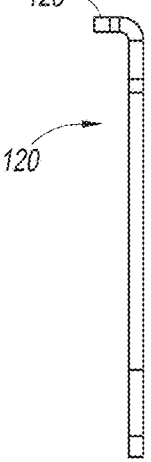
FIG. 2E

PISTOL LOWER RECEIVER REAR RAIL INSERTS

INCORPORATION BY REFERENCE TO ANY PRIORITY APPLICATIONS

This application claims the benefit of U.S. Provisional Application Ser. No. 63/263,915, filed Nov. 11, 2021, entitled PISTOL LOWER RECEIVER REAR RAIL INSERTS, the entire disclosure of which is herein incorporated by reference.

BACKGROUND

Field

This invention relates to systems, methods, and devices for guide rails for a pistol frame that can be finished and/or assembled by a user.

Related Art

A pistol frame generally includes a grip, a trigger guard, and an upper rim that receives a slide. The pistol frame can include one or more rails that extend from the upper rim and are used to couple with the slide. Typically, two sides of the upper rim each include front and rear rails. These rails can be made of a metal, such as steel, and overmolded within the polymer forming the pistol frame.

SUMMARY

In an embodiment, a pistol frame is disclosed. The pistol frame may comprise a trigger mechanism recess; an upper rim extending about the trigger mechanism recess; a rear rail insert recess within the trigger mechanism recess; a left rear rail insert including an upper portion and a lower portion, the upper portion including a left rail, the lower portion including a first pin aperture; a right rear rail insert including an upper portion and a lower portion, the upper portion including a right rail, the lower portion including a second pin aperture; a first pin hole aligned with the trigger mechanism recess; and a second pin hole aligned with the trigger mechanism recess; wherein the lower portion of the left rear rail insert is disposed within the rear rail insert recess and the left rear rail extends above the upper rim; wherein the lower portion of the right rear rail insert is disposed within the rear rail insert recess and the right rear rail extends above the upper rim; and wherein a pin extends through the first and second pin holes and through the first and second pin apertures.

BRIEF DESCRIPTION OF THE DRAWINGS

The invention description below refers to the accompanying drawings, of which:

FIG. 2A is a perspective view of a left, rear rail insert, according to an illustrative embodiment;

FIG. 2B is a first side view of the left, rear rail insert, according to the illustrative embodiment;

FIG. 2C is a second side view of the left, rear rail insert, according to the illustrative embodiment;

FIG. 2D is a front edge view of the left, rear rail insert, according to the illustrative embodiment;

FIG. 2E is a back edge view of the left, rear rail insert, according to the illustrative embodiment;

DETAILED DESCRIPTION

Figure 1A:
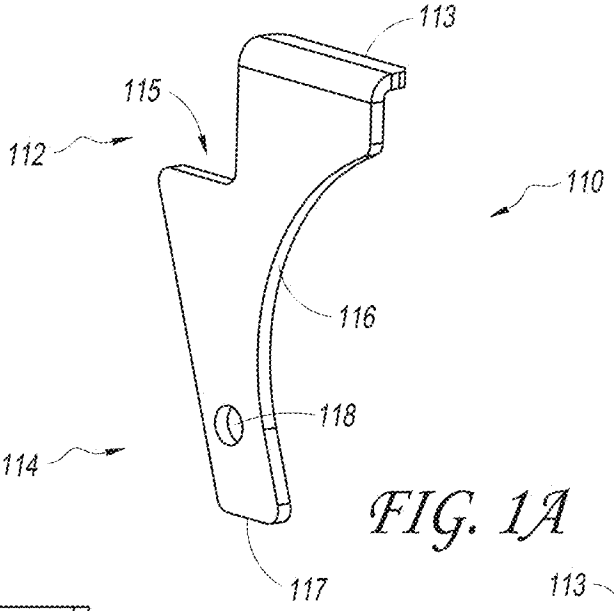
FIG. 1A is a perspective view of a right, rear rail insert, according to an illustrative embodiment.
Figure 1B:
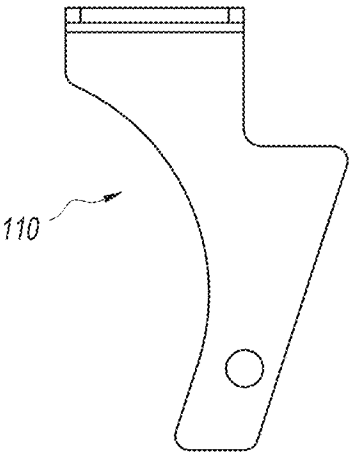
FIG. 1B is a first side view of the right, rear rail insert, according to the illustrative embodiment.
Figure 1C:
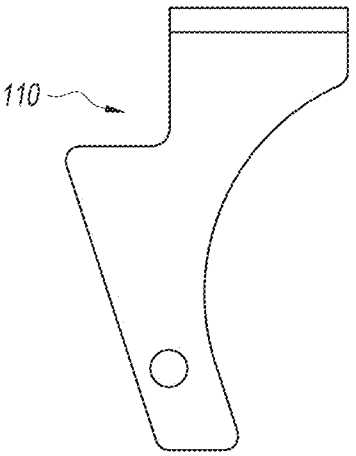
FIG. 1C is a second side view of the right, rear rail insert, according to the illustrative embodiment.
Figure 1D:
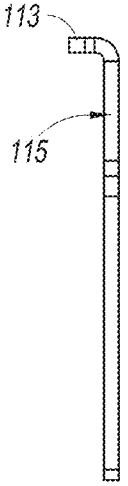
FIG. 1D is a front edge view of the right, rear rail insert, according to the illustrative embodiment.
Figure 1E:
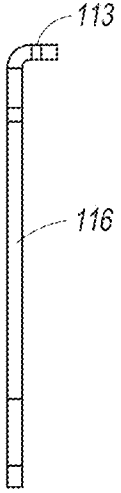
FIG. 1E is a back edge view of the right, rear rail insert, according to the illustrative embodiment.

FIGS. 1A-1E illustrate a right, rear rail insert 110. FIG. 1A shows a perspective view of the insert 110. FIG. 1B shows a first side of the insert 110. FIG. 1C shows a second side of the insert 110. FIG. 1D shows the front edge of the insert 110. FIG. 1E shows a back edge of the insert 110, including a curved surface 116. The right rear rail insert 110 can include an upper portion 112 and a lower portion 114. The upper portion 112 can include a right rear rail 113. The upper portion 112 can also include a cut out region 115. The cut out region 115 can include a square, rectangular, and/or the like cut out portion of a body of the insert 110. The cut out region 115 can be located on a front side of the insert 110. The rear side of the insert 110 can include the curved surface 116. The curved surface 116 can extend across the upper portion 112 and/or the lower portion 114. The lower portion 114 can include a lower end 117. The lower end 117 can be generally rectangular. The lower portion 114 can include an aperture 118. The aperture 118 may comprise a circle, square, rectangle, and/or the like hole extending through the body of the insert 110. Optionally the insert 110 can include a marking such as an "R" that indicates that the insert 110 is a right rear rail insert, which may aid a user in assembly of a finished pistol. The right rail 113 can comprise a bent portion of the insert 110. The right rear rail 113 can be bent at approximately 90 degrees relative to the body of the insert 110. The insert 110 can be formed out of a single sheet of metal, such as, for example, steel.

FIGS. 2A-2E illustrate a left, rear rail insert 120. FIG. 2B shows a perspective view of the insert 120. FIG. 2B shows a first side of the insert 120. FIG. 2C shows a second side of the insert 120. FIG. 2D shows the front edge of the insert 120. FIG. 2E shows a back edge of the insert 120, including a curved surface 126. The left rear rail insert 120 can include an upper portion 122 and a lower portion 124. The upper portion 122 can include a left rear rail 123. The upper portion 122 can also include a cut out region 125. The cut out region 125 can include a square, rectangular, and/or the like cut out portion of a body of the insert 120. The cut out region 125 can be located on a front side of the insert 120. The rear side of the insert 120 can include the curved surface 126. The curved surface 126 can extend across the upper portion 122 and/or the lower portion 124. The lower portion 124 can include a lower end 127. The lower end 127 can be generally rectangular. The lower portion 124 can include an aperture 128. The aperture 128 may comprise a circle, square, rectangle, and/or the like hole extending through the body of the insert 120. Optionally the insert 120 can include a marking such as an "L" that indicates that the insert 120 is a left rear rail insert, which may aid a user in assembly of a finished pistol. The left rail 123 can comprise a bent portion of the insert 120. The left rail 123 can be bent at approximately 90 degrees relative to the body of the insert 120. The insert 120 can be formed out of a single sheet of metal, such as, for example, steel.

Figure 3:
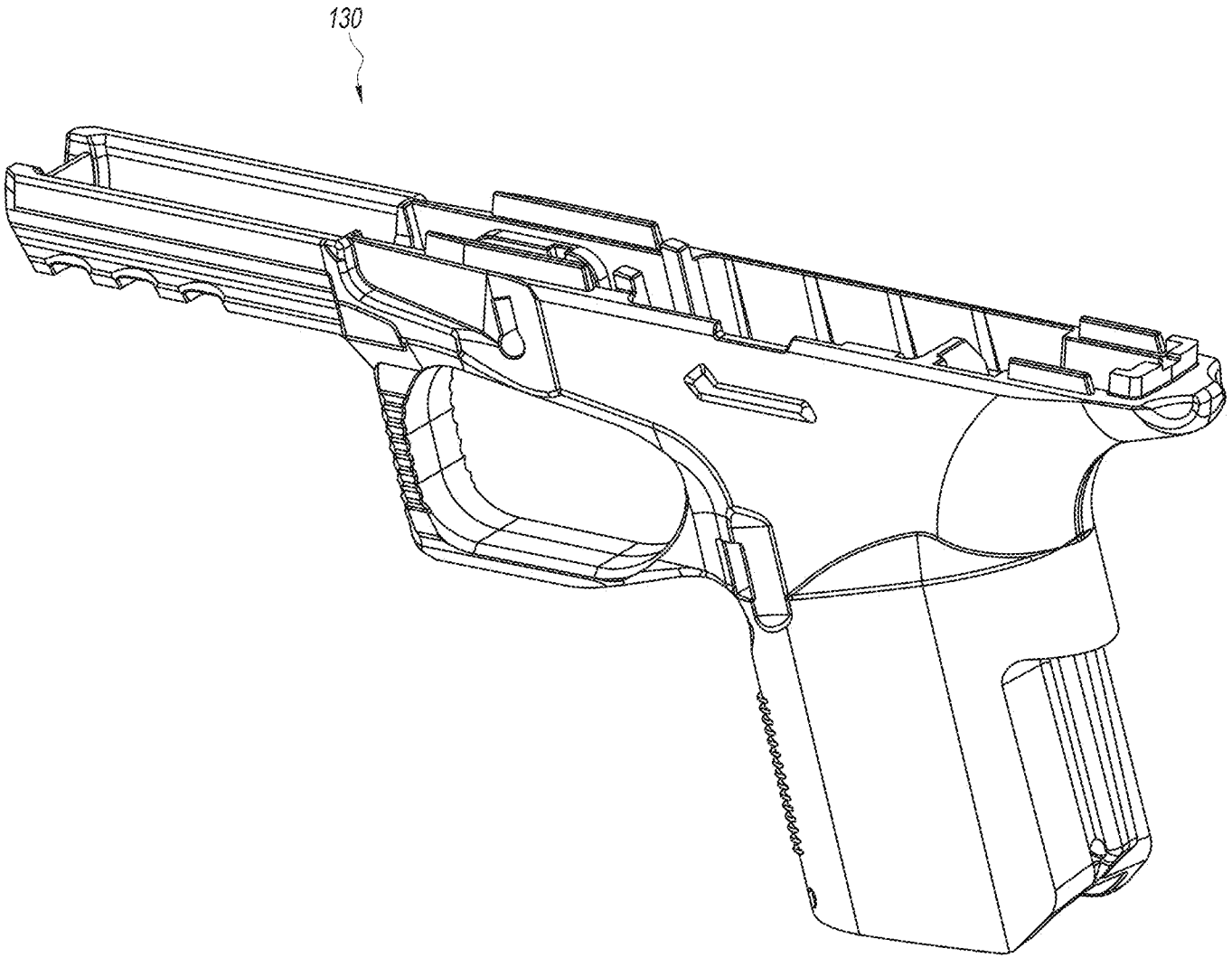
FIG. 3 is a perspective view of an unfinished pistol frame, according to an illustrative embodiment.

FIG. 3 illustrates an unfinished pistol frame 130. The advancements described in the present application can be used either in context of a finished or unfinished pistol frame.

Figure 4:
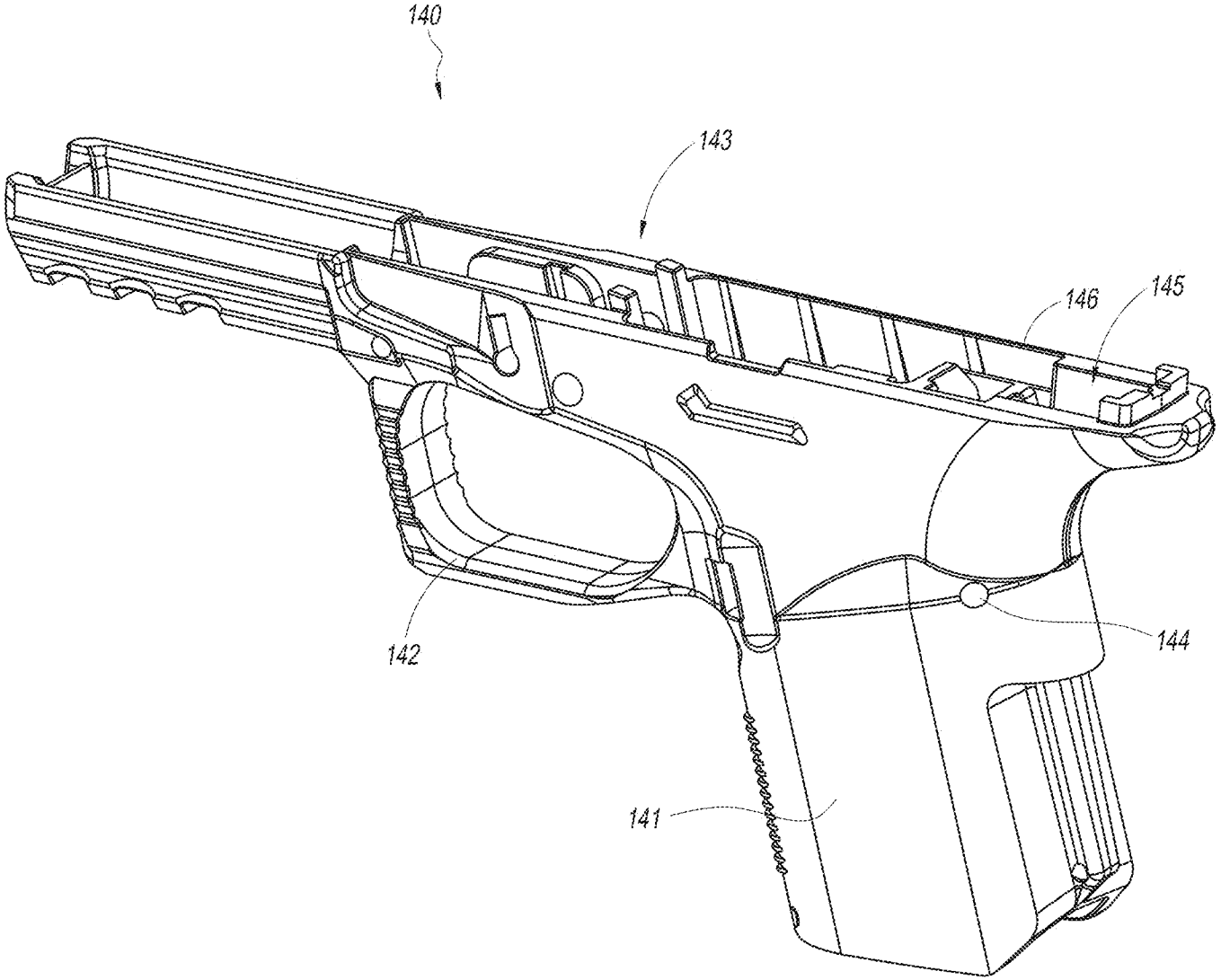
FIG. 4 is a perspective view of a finished pistol frame, according to an illustrative embodiment.

FIG. 4 illustrates a finished pistol frame 140. The finished pistol frame 140 can include a grip portion 141, a trigger guard 142, and an upper face 143. A pin aperture or pinhole 144 can extend through the frame 140. The upper face 143 can open to a trigger mechanism recess 145. The trigger mechanism recess 145 can be at least partially surrounded by an upper rim 146. The upper rim 146 can extend about the upper face 143. The trigger mechanism recess 145 can be recessed inwardly towards the pin aperture 144 and/or the grip portion 141. The trigger mechanism recess 145 can be located on a rear portion of the frame 140.

Figure 5A:
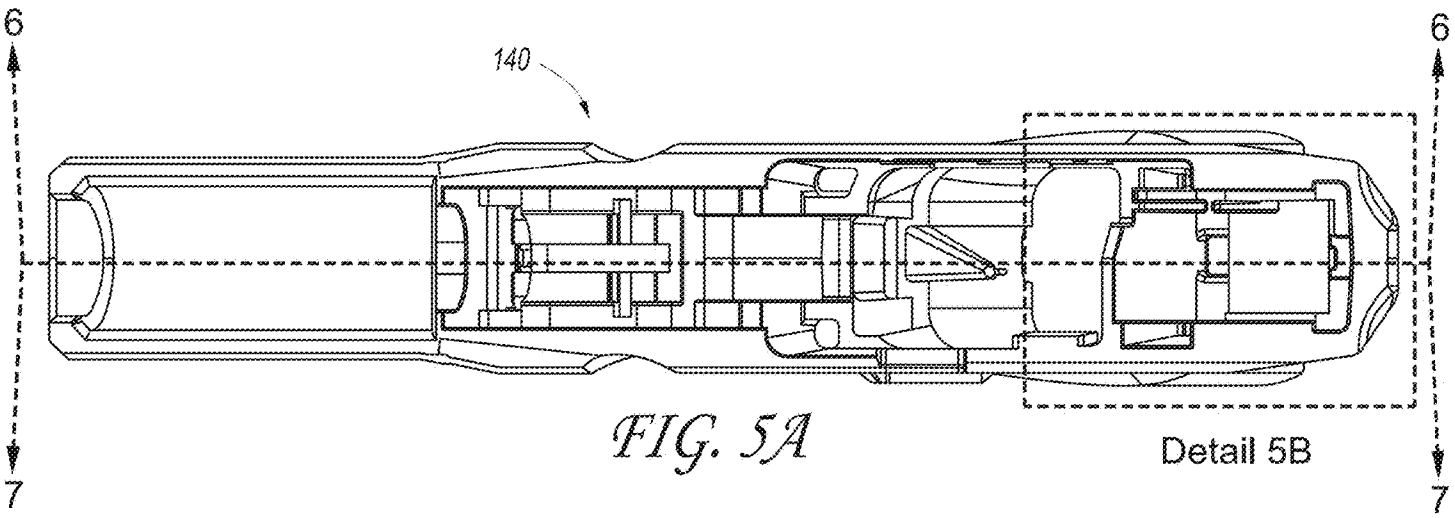
FIG. 5A is a top view of the finished pistol frame, according to the illustrative embodiment.
Figure 5B:
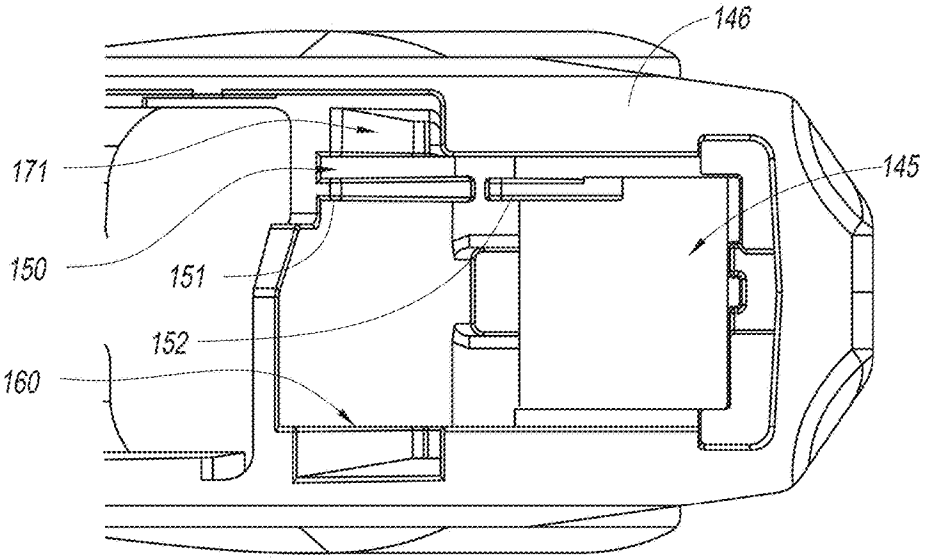
FIG. 5B is a detailed view of the finished pistol frame, according to the illustrative embodiment.

FIG. 5A shows a top view of the frame 140. Detail 5B (as shown in FIG. 5B) is a detailed view of the trigger mechanism recess 145. The frame 140 can include a right rear rail insert recess 150. The recess 150 can extend along a first side of the trigger mechanism recess 145. The recess 150 can be oriented along a front rear axis of the frame 140. The recess 150 can be at least partially defined by a forward wall 151. The forward wall 151 can form a slot, with the other side of the slot being an outer portion of the frame 140. The recess 150 can include a rearward wall 152. The rearward wall 152 can form a rearward slot as a portion of the recess 150. The other side of the slot can be the outer wall of the frame 140. The recess 150 can be at least partially opened towards the trigger mechanism recess 145 and/or towards the upper face 143. Alternatively, the trigger mechanism recess 145 can include a U-shaped recess.

The frame 140 can include a left rear rail insert recess 160. The recess 160 can be located along a left side of the trigger mechanism recess 145. The recess 160 can be oriented along a forward-rear axis of the frame 140. The recess 150 can be on an opposite side of the trigger mechanism recess 145 from the recess 160. The recess 160 can be opened along an upper side and/or along an inner side of the trigger mechanism recess 145.

Figure 6:
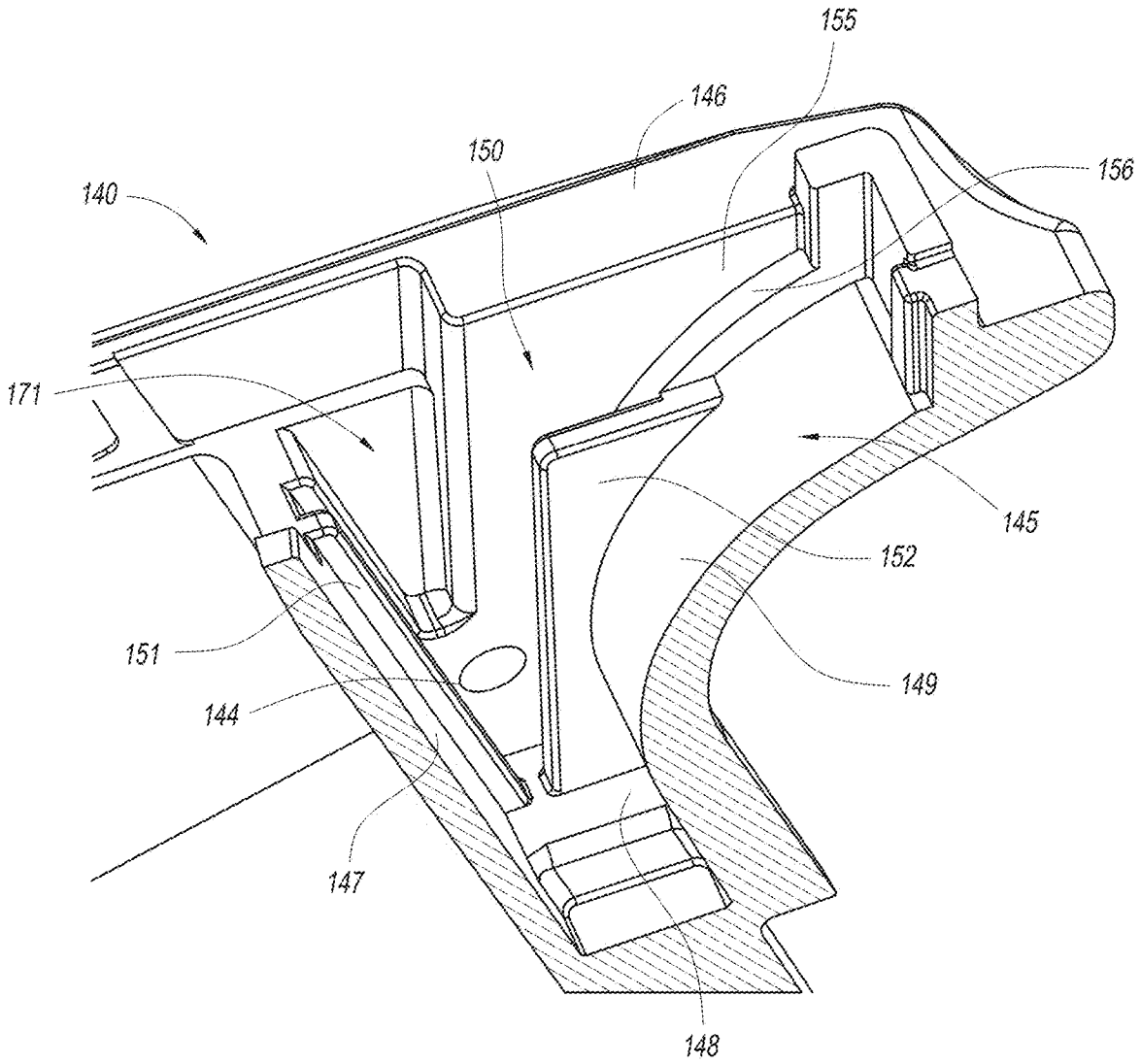
FIG. 6 is a section view of the finished pistol frame along the line 6-6 in FIG. 5A, according to the illustrative embodiment.

FIG. 6 shows a section view taken along the line 6-6 in FIG. 5A. FIG. 6 shows the trigger mechanism recess 145 and the recess 150. The trigger mechanism recess 145 is at least partially defined by a rearward curved wall 149. The trigger mechanism recess 145 can further be defined by a lower wall 148 and a front wall 147. The recess 150 can be partially defined by an outer wall 155. The outer wall 155 can be a portion of the frame 140. The recess 150 can include a rearward curved wall 156. The rearward curved wall 156 can follow the rearward curved wall 149 of the trigger mechanism recess 145. The rearward curved wall 156 can have a thickness equivalent to the insert 110. The rearward wall 152 can project from the rearward curved wall 149 to form a rearward slot portion of the recess 150. The rearward wall 152 can extend from a lower end at the lower wall 148 towards the upper rim 146. The forward wall 151 can similarly extend from the lower wall 148 upwardly towards the upper rim 146. The frame 140 can include a side cut out region 171. The side cut out region 171 can be located adjacent to the recess 150. As shown in FIG. 6, the frame 140 can include the pinhole 144. Specifically, the pinhole 144 shown in FIG. 6 is one half of the pinhole 144 that extends through both sides of the trigger mechanism recess 145, as shown in FIG. 4. The pinhole 144 can be aligned in a lower portion of the recess 150. The pinhole 144 can be forward of the rearward curved walls 149, 156.

Figure 7:
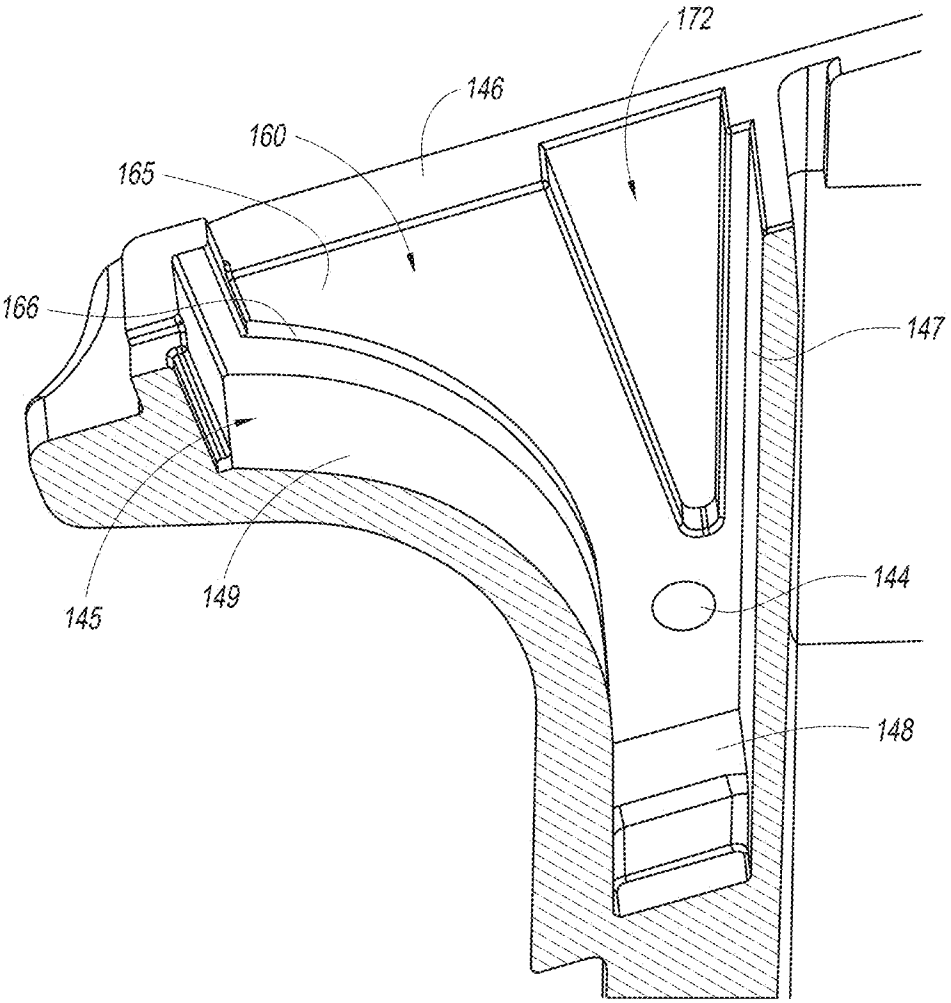
FIG. 7 is a section view of the finished pistol frame along the line 7-7 in FIG. 5A, according to the illustrative embodiment.

FIG. 7 shows a section view taken along the lines 7-7 in FIG. 5A. FIG. 7 shows the left rear rail insert recess 160. The recess 160 can at least partially be defined by an outer wall 165. The outer wall 165 can be a portion of the frame 140. The recess 160 can include a rearward curved wall 166. The rearward curved wall 166 can have a thickness (from the outer wall 165) equivalent to the insert 120. The rearward curved wall 166 can parallel the rearward curved wall 149. The pinhole 144 can be aligned with a lower portion of the recess 160. The frame 140 can include a spacing 172 approximate or adjacent to the recess 160. The recess 160 may not include any vertical, forward, rearward or other walls that separate it from the trigger mechanism recess 145.

Figure 8:
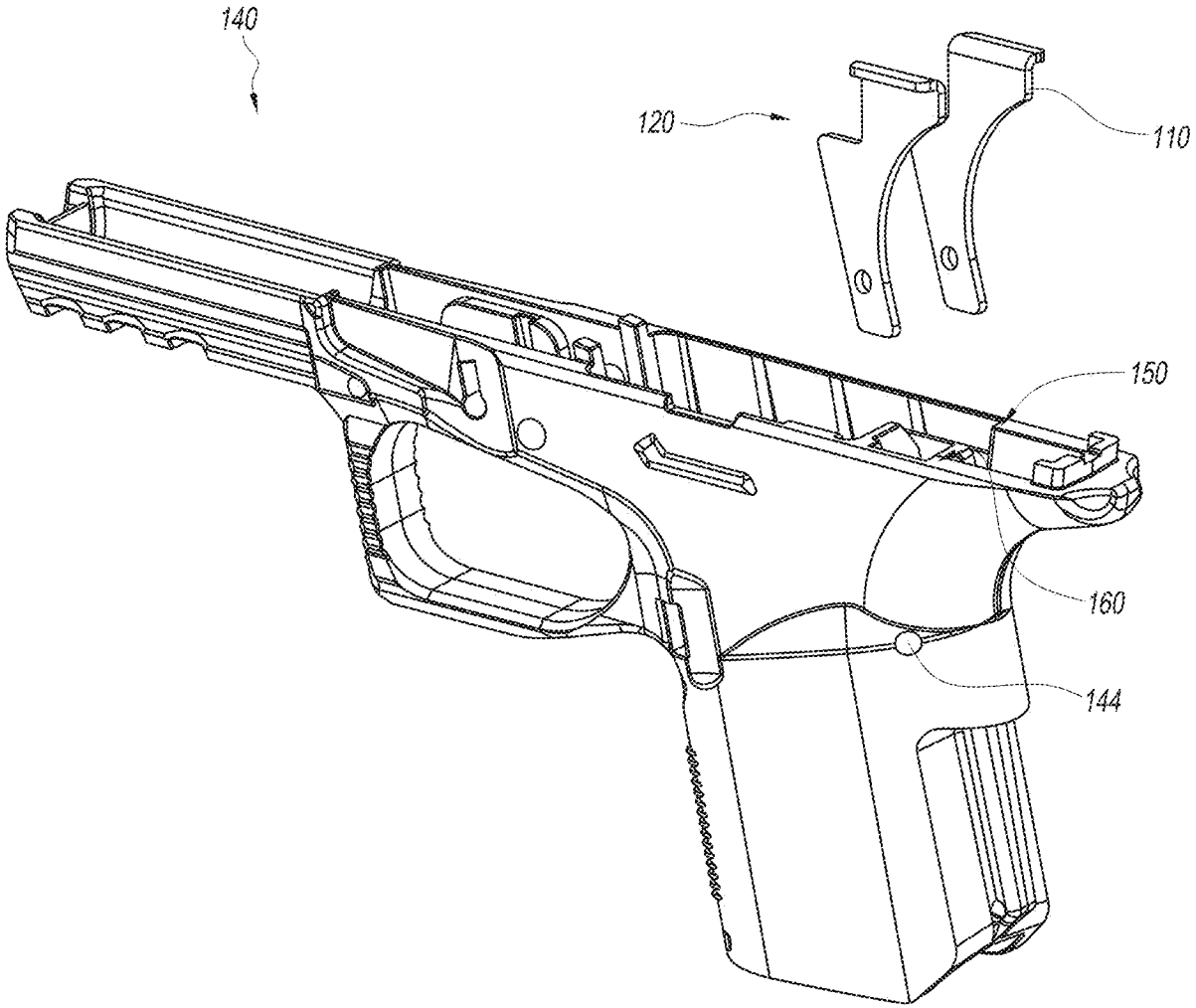
FIG. 8 is an exploded perspective view of the finished pistol frame, according to the illustrative embodiment.

FIG. 8 shows an exploded perspective view of the frame 140 with the right rear rail insert 110 aligned with the right rear rail insert recess 150. FIG. 8 further shows the left rear rail insert 120 aligned with the left rear rail insert recess 160.

Figure 9:
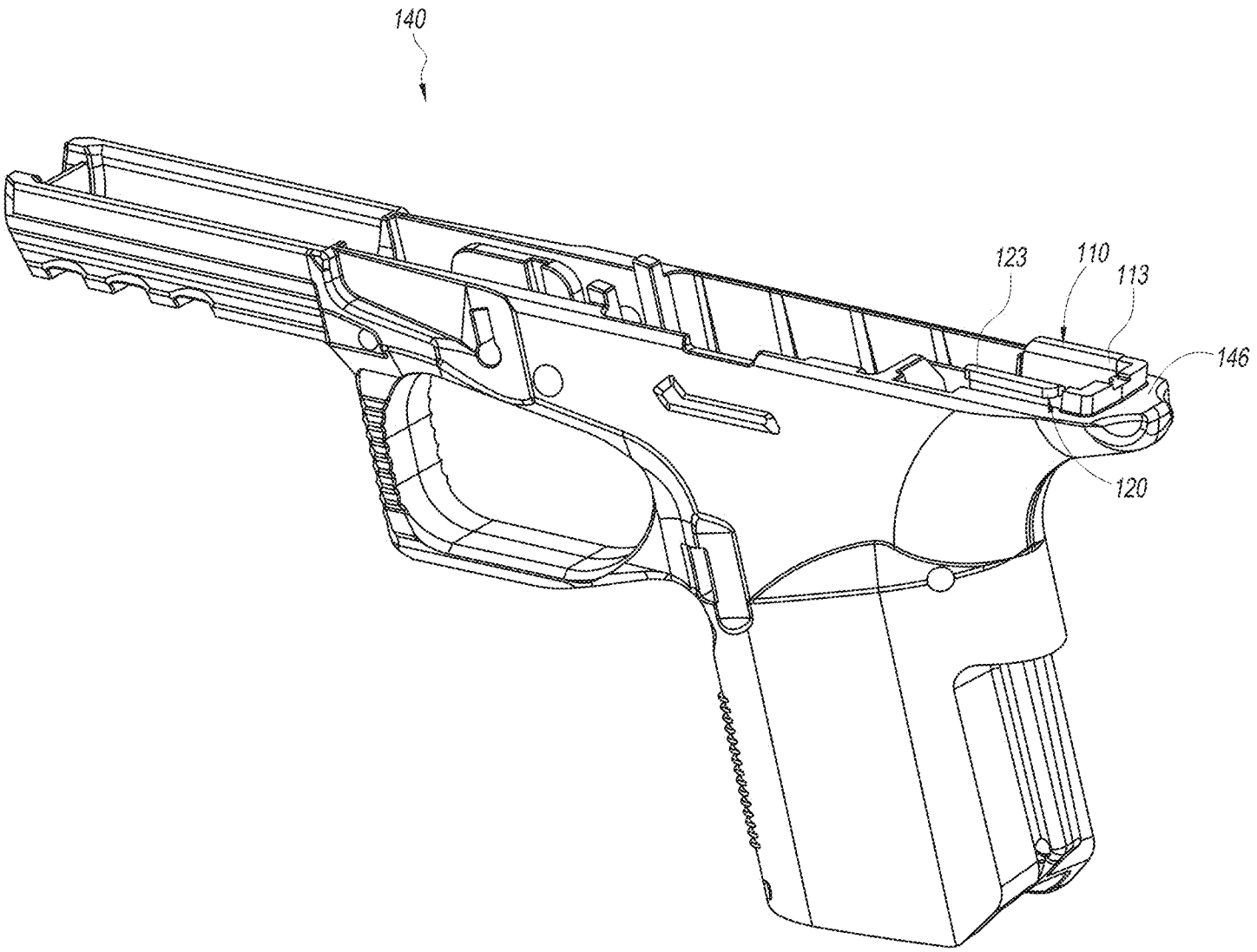
FIG. 9 is a perspective assembly view of the finished pistol frame, according to the illustrative embodiment.

FIG. 9 shows an assembly view of the left and right rear rail inserts 120, 110 inserted within the respective left and right rear rail insert recesses 160, 150. The right rear rail insert 110 can include the right rear rail 113. The right rear rail 113 can extend outwardly over the upper rim 146 on the right side of the frame 140. The lower portions of the insert 110 can be inserted within the recess 150. The left rear rail 123 can extend outward over the upper rim 146 of the frame 140 while lower portions of the left rear rail insert 120 are inserted within the recess 160.

Figure 10A:
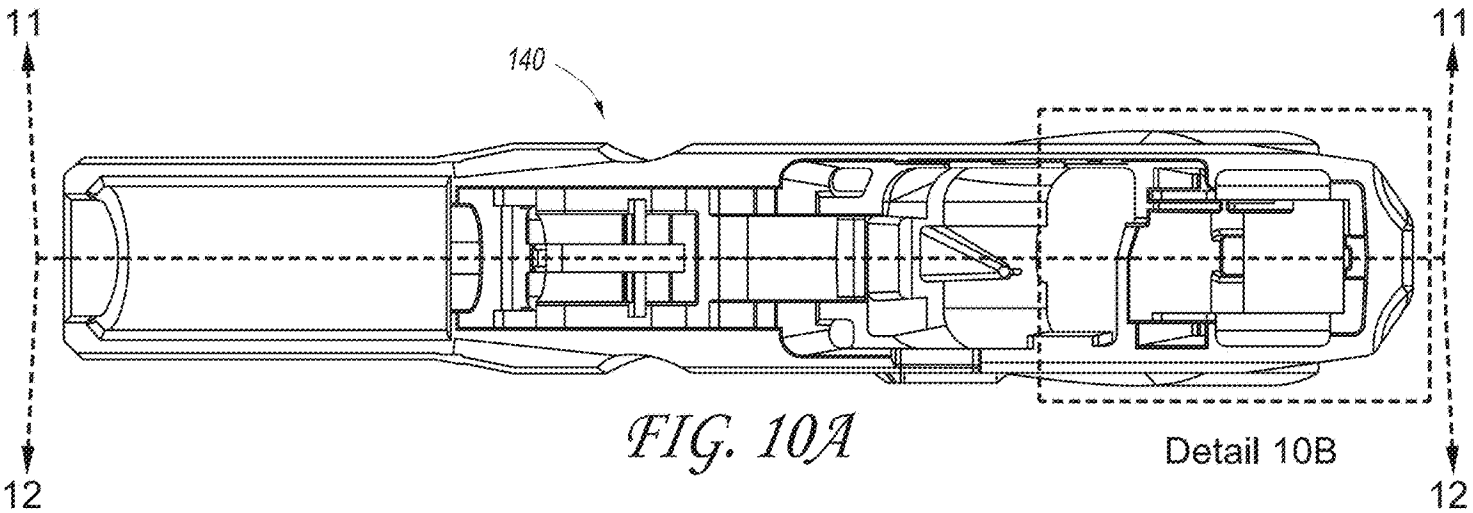
FIG. 10A is a top view of the finished pistol frame and the right and left rear rail inserts, according to an illustrative embodiment.
Figure 10B:
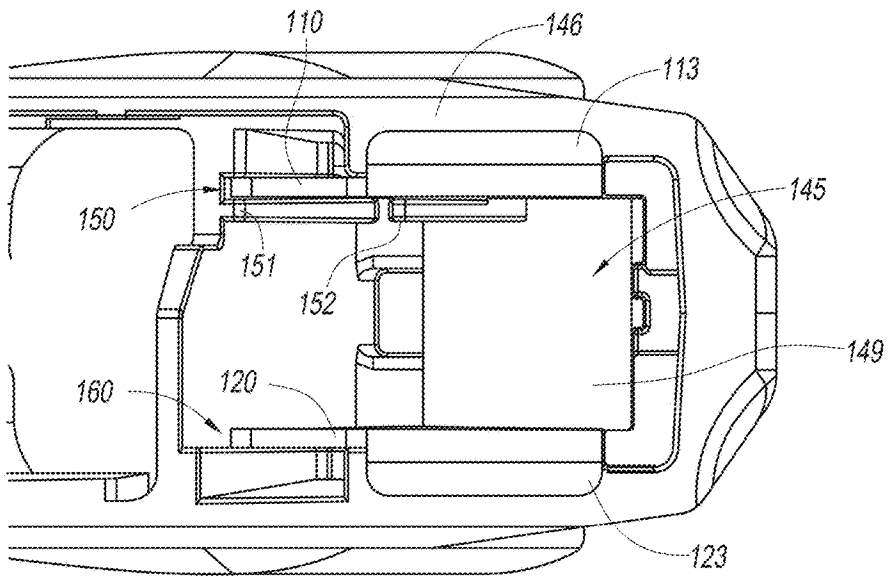
FIG. 10B is a detailed view of the finished pistol frame and the right and left rear rail inserts, according to the illustrative embodiment.
Figure 11:
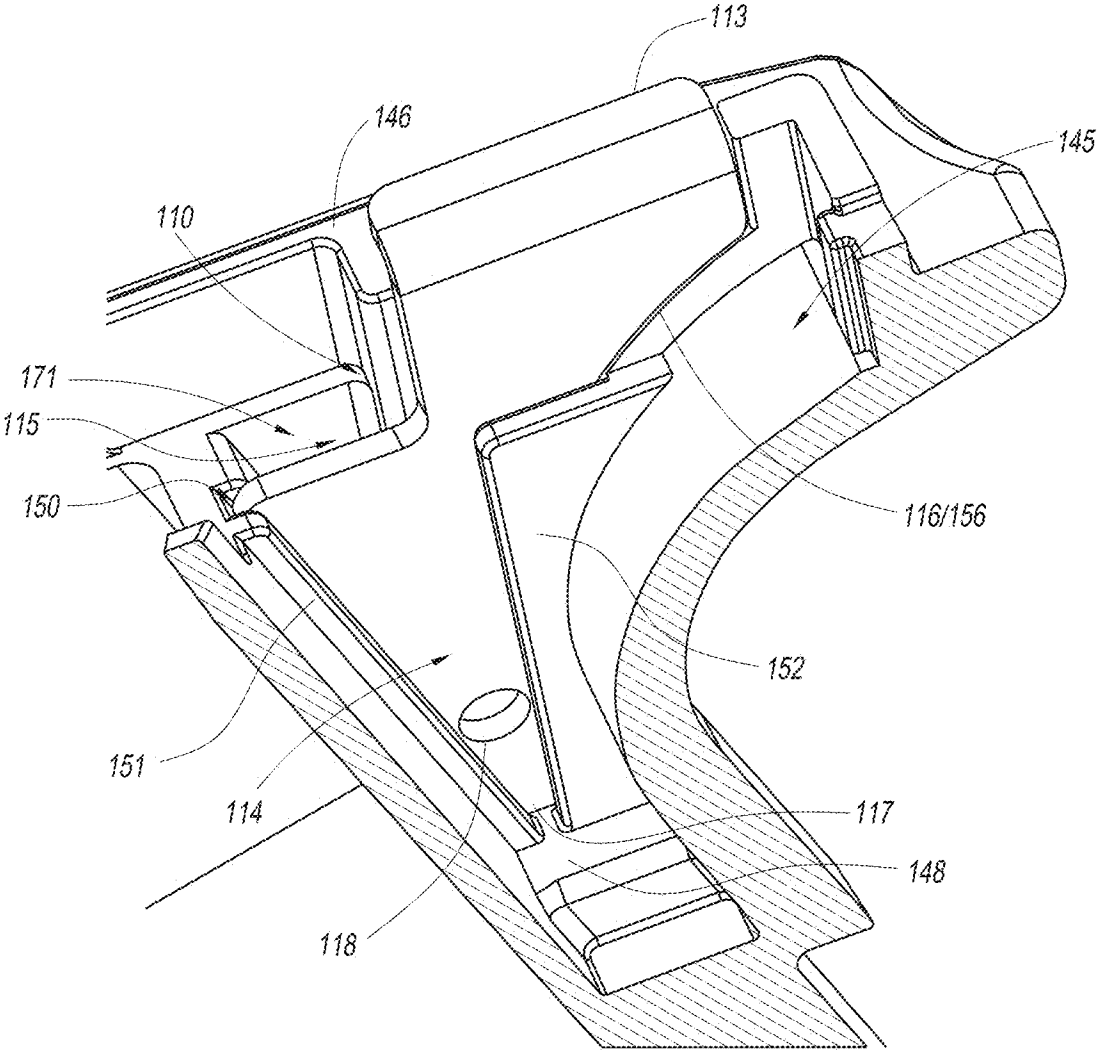
FIG. 11 is a section view of the finished pistol frame and the right, rear rail insert along the line 11-11 in FIG. 10A, according to the illustrative embodiment.

FIG. 10A shows a top view of the frame 140. Detail 10B (as shown in FIG. 10B) is a detailed view of the trigger mechanism recess 145. FIG. 11 shows a section view taken along the line 11-11 in FIG. 10A. In FIG. 11, the right rear rail insert 110 is inserted in the recess 150. The forward edge of the body of the insert 110 is inserted within the slot formed by the forward wall 151. The curved surface 116 can abut and align with the rearward curved wall 156. The rearward wall 152 forming the rearward slot can encompass a portion of the lower portion 114, such as, for example, the curved surface 116. The aperture 118 can be aligned with the pinhole 144. The lower end 117 can abut the lower wall 148. The front wall of the insert 110 can abut the forward surface of the recess 150. The cut out region 115 can be approximately in line with the side cut out region 171.

Figure 12:
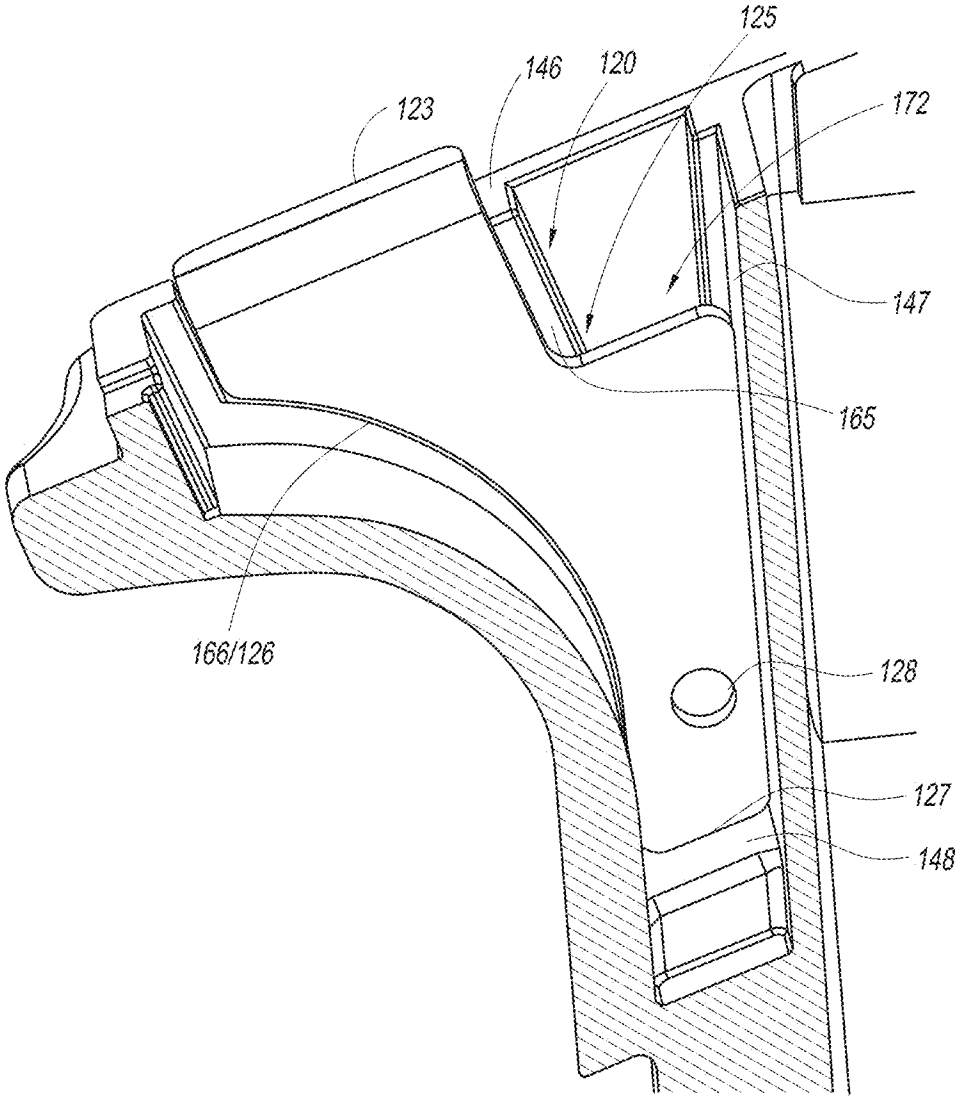
FIG. 12 is a section view of the finished pistol frame and the left, rear rail insert along the line 12-12 in FIG. 10A, according to the illustrative embodiment.

FIG. 12 shows a section view taken along the line 12-12 in FIG. 10A. In FIG. 12, the left rear rail insert 120 is located within the recess 160. The aperture 128 can align with the pinhole 144. The lower end 127 can abut the lower wall 148. The forward edge can abut the front wall 147. The curved surface 126 can abut the rearward curves wall 166. The left rear rail 123 can overlap the upper rim 146. The body of the rail insert 120 can be flush against the outer wall 165. The cut out region 125 can approximately align with the spacing 172.

Figure 13:
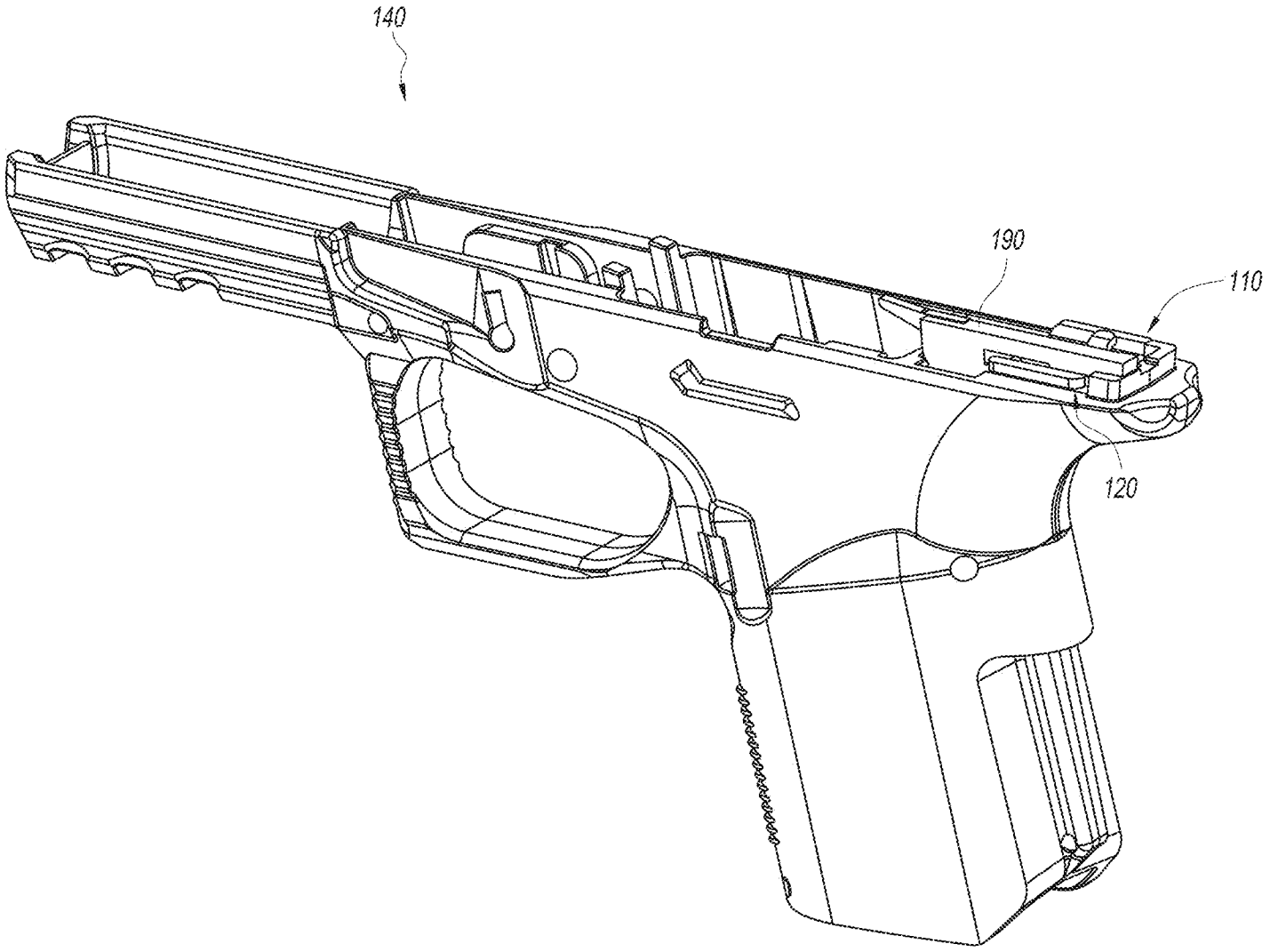
FIG. 13 is a perspective assembly view of the finished pistol frame and a trigger mechanism housing, according to an illustrative embodiment.
Figure 14A:
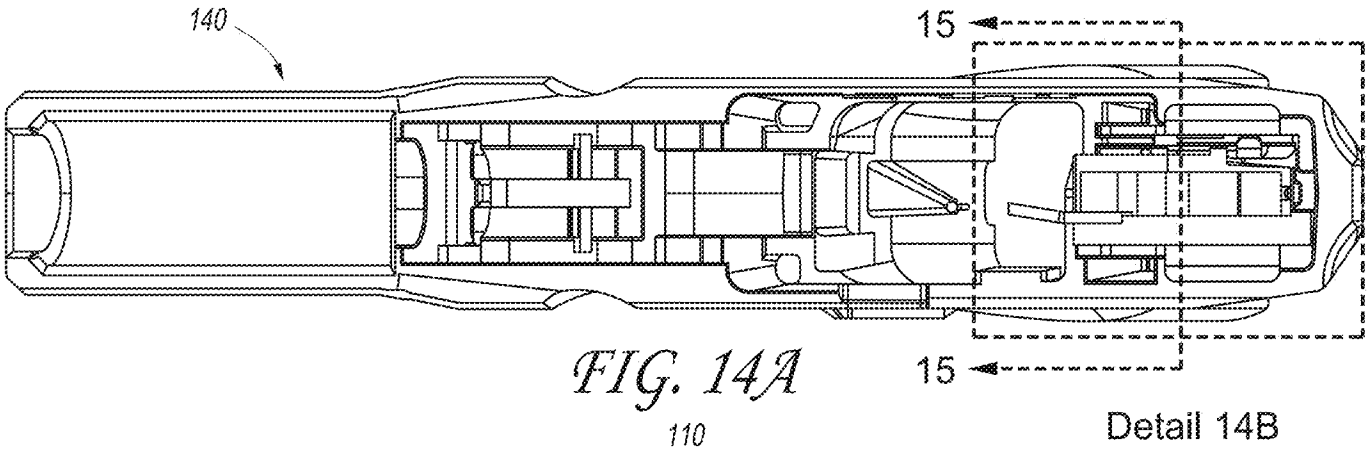
FIG. 14A is a top view of the finished pistol frame and the trigger mechanism housing, according to the illustrative embodiment.
Figure 14B:
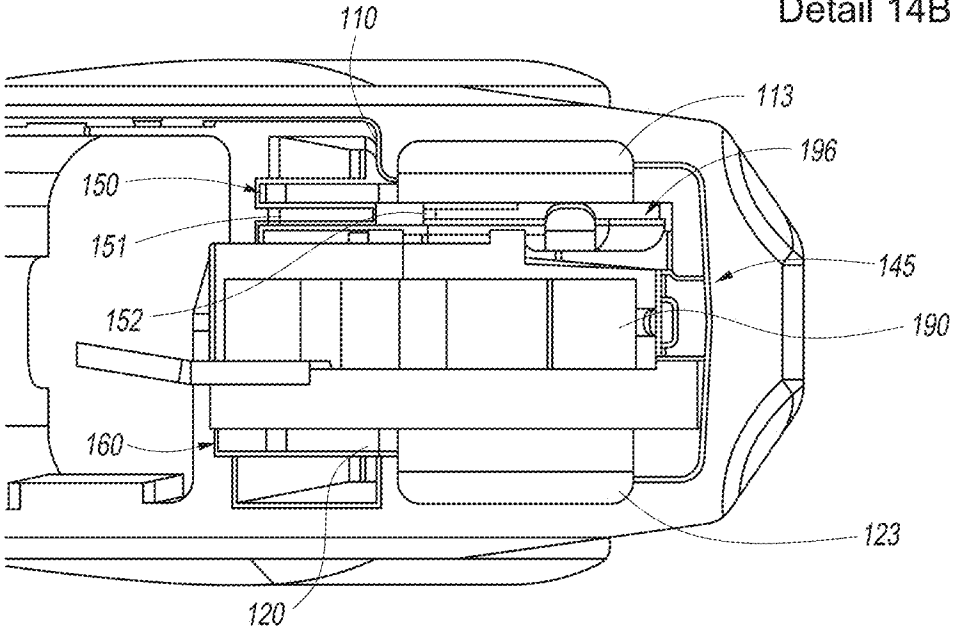
FIG. 14B is a detailed view of the finished pistol frame and the trigger mechanism housing, according to the illustrative embodiment.

FIG. 13 shows a perspective assembly view of the frame 140 with a trigger mechanism housing 190 within the trigger mechanism recess 145. FIG. 14A shows a top view of the frame 140 with the trigger mechanism housing 190. Detail 14B (as shown in FIG. 14B) is a detailed view of the trigger mechanism recess 145 with the trigger mechanism housing 190. The trigger mechanism housing 190 can be positioned between the left and right rear rail inserts 120, 110, when the left and right rear rail inserts 120, 110 are inserted within the respective left and right rear rail insert recesses 160, 150. The forward and/or rearward walls 151, 152 can be positioned or sized to space the trigger mechanism housing 190 within the trigger mechanism recess 145. The trigger mechanism housing 190 can be spaced a spacing 196 away from the right wall of the trigger mechanism recess 145. This spacing 196 can provide space for the trigger bar/connector. The trigger mechanism housing 190 can abut the left wall of the trigger mechanism recess 145 (e.g., the left rear rail insert 120). As described below, a pin 195 can extend through a corresponding aperture in the trigger mechanism housing 190.

Figure 15:
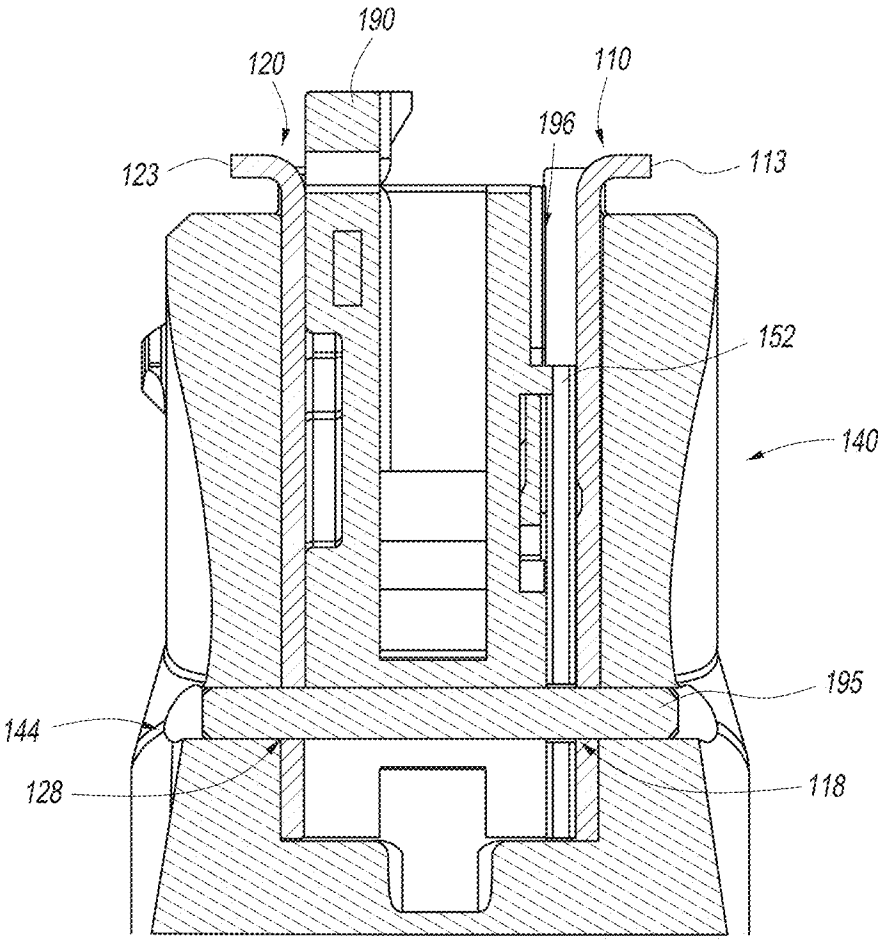
FIG. 15 is a section view of the finished pistol frame and the trigger mechanism housing along the line 15-15 in FIG. 14A, according to the illustrative embodiment.

FIG. 15 is a section view of the frame 140 and the trigger mechanism housing 190 along the line 15-15 in FIG. 14A. FIG. 15 shows the frame 140 in another assembly step (e.g., after inserting the left and right rear rail inserts 120, 110) where the pin 195 (e.g., as shown in FIG. 15) can be inserted into the pinhole 144 and through the apertures 118, 128 of the inserts 110, 120. In some embodiments, the left rear rail insert 120 and the right rear rail insert 110 are only directly connected by the pin 195. The pin 195 may correspond to the shape of the pinhole 144 and the apertures 118, 128. For example, the pin 195 may comprise a round cylindrical pin. As shown in FIG. 15, the pin 195 can be used to lock the inserts 110, 120 with the lower portions thereof 114, 124 disposed within the recesses 150, 160 and the rear rails 113, 123 extending outward and overlapping the upper rim 146, respectively. The rear rails 113, 123 are configured to engage with a slide that reciprocates along the upper face 143 and the frame 140.

In some embodiments, any of the components described herein may be included in a kit, which may be used for, for example, distribution. The kit may be defined by a package or container and may include sub-packages or sub-containers for individual components. For example, the kit may include an unfinished pistol frame (e.g., the unfinished pistol frame 130) and/or a finished pistol frame (e.g., the finished pistol frame 140). Additionally, the kit may include one or more right, rear rail inserts (e.g., the right, rear rail insert 110), one or more left, rear rail inserts (e.g., the left, rear rail insert 120), one or more grip portions (e.g., the grip portion 141), one or more trigger guards (e.g., the trigger guard 142), one or more trigger mechanism housings (e.g., the trigger mechanism housing 190), one or more pins (e.g., the pin 195), and/or the like. In some embodiments, the kit may optionally include additional components not discussed in this application.

Certain Terminology

Terms of orientation used herein, such as "top." "bottom," "proximal." "distal," "longitudinal," "lateral," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z." unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately." "about." and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

SUMMARY

Several illustrative examples of frames have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one example in this disclosure can be combined or used with (or instead of) any other portion of any of the steps, processes, structures, and/or devices disclosed or illustrated in a different example or flowchart. The examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular example of the inventions disclosed herein. No aspects of this disclosure are essential or indispensable. In many examples, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the examples described and illustrated in the figures. Many implementation variations are possible. Any of the features, structures, steps, or processes disclosed in this specification can be included in any example.

In summary, various examples of frames and related methods have been disclosed. This disclosure extends beyond the specifically disclosed examples to other alternative examples and/or other uses of the examples, as well as to certain modifications and equivalents thereof. Moreover, this disclosure expressly contemplates that various features and aspects of the disclosed examples can be combined with, or substituted for, one another. Accordingly, the scope of this disclosure should not be limited by the particular disclosed examples described above, but should be determined only by a fair reading of the claims.

What is claimed is:

1. A pistol frame, comprising:

a trigger mechanism recess;

an upper rim extending about the trigger mechanism recess;

left and right rear rail insert recesses outboard of the trigger mechanism recess, at least one of the rail insert recesses having an outer wall and an at least partial inner wall spaced inboard from the outer wall defining a rear-rail-receiving space therebetween;

a left rear rail insert including an upper portion and a lower portion, the upper portion including a left rail, the lower portion including a first pin aperture;

a right rear rail insert including an upper portion and a lower portion, the upper portion including a right rail, the lower portion including a second pin aperture;

a first pin hole aligned with the trigger mechanism recess; and a second pin hole aligned with the trigger mechanism recess;

wherein the lower portion of the left rear rail insert is disposed within the left rear rail insert recess and the left rear rail extends above the upper rim;

wherein the lower portion of the right rear rail insert is disposed within the right rear rail insert recess and the right rear rail extends above the upper rim; and wherein a pin extends through the first and second pin holes and through the first and second pin apertures.

2. The pistol frame of claim 1, wherein the rear rail insert recess includes:

a first rear rail insert recess on a first side of the trigger mechanism recess; and a second rear rail insert recess on a second side of the trigger mechanism recess;

wherein the lower portion of the left rear rail insert is inserted within the first rear rail insert recess and the lower portion of the right rear rail insert is inserted within the second rear rail insert recess.

3. The pistol frame of claim 2, wherein the left rear rail insert and the right rear rail insert are separate components capable of being independently inserted into the respective first and second rear rail recesses.

4. The pistol frame of claim 3, wherein the left rear rail insert and the right rear rail insert are only directly connected by the pin.

5. The pistol frame of claim 2, wherein the second rear rail insert recess includes a forward rail slot and a rearward rail slot.

6. The pistol frame of claim 5, wherein a trigger mechanism is disposed within the trigger mechanism recess and a wall of the rearward rail slot and/or a wall of the forward rail slot offsets the trigger mechanism from the right rear rail insert.

7. The pistol frame of claim 1, wherein the rear rail insert recess includes a U-shaped portion.

8. The pistol frame of claim 1, wherein the pistol frame is an unfinished pistol frame.

9. A kit for a pistol frame, the kit comprising:

a pistol frame, the pistol frame comprising:

a trigger mechanism recess;

an upper rim extending about the trigger mechanism recess;

left and right rear rail insert recesses outboard of the trigger mechanism recess, at least one of the rail insert recesses having an outer wall and an at least partial inner wall spaced inboard from the outer wall defining a rear-rail-receiving space therebetween;

a first pin hole aligned with the trigger mechanism recess; and a second pin hole aligned with the trigger mechanism recess;

a left rear rail insert including an upper portion and a lower portion, the upper portion including a left rail, the lower portion including a first pin aperture;

a right rear rail insert including an upper portion and a lower portion, the upper portion including a right rail, the lower portion including a second pin aperture; and a pin.

10. The kit of claim 9, wherein the pistol frame comprises an unfinished pistol frame.

11. The kit of claim 9, wherein the kit comprises a container.

12. The kit of claim 9, wherein the kit further comprises one or more sub-containers.

* * * * *